United States Patent [19]

Madigan

[11] Patent Number: 4,542,798

[45] Date of Patent: Sep. 24, 1985

[54] NOZZLE ASSEMBLY FOR AN EARTH BORING DRILL BIT

[75] Inventor: James A. Madigan, Spring, Tex.

[73] Assignee: Reed Rock Bit Company, Houston, Tex.

[21] Appl. No.: 575,644

[22] Filed: Jan. 31, 1984

[51] Int. Cl.[4] ..... E21B 10/18

[52] U.S. Cl. ..... 175/340; 175/393; 175/422

[58] Field of Search ..... 175/339, 340, 393, 422; 239/600

[56] References Cited

U.S. PATENT DOCUMENTS

| | | | |
|---|---|---|---|
| 3,111,179 | 11/1963 | Albers et al. | 175/393 |
| 3,131,779 | 5/1964 | Rowley et al. | 175/393 |
| 3,189,107 | 6/1965 | Galle | 175/393 |
| 4,392,534 | 7/1983 | Miida | 175/422 |
| 4,400,024 | 8/1983 | Ratcliff et al. | 175/340 |
| 4,429,755 | 2/1984 | Williamson | 175/393 |

*Primary Examiner*—Stephen J. Novosad
*Assistant Examiner*—William P. Neuder
*Attorney, Agent, or Firm*—Carl A. Rowold

[57] ABSTRACT

A nozzle assembly for an earth boring drill bit of the type adapted to receive drilling fluid under pressure and having a nozzle bore in the bottom thereof positioned closely adjacent the well bore bottom when the bit is in engagement therewith with the bore having inner and outer portions. The nozzle assembly comprises a generally cylindrical nozzle member of abrasion and erosion resistant material, selected from a plurality of such members, each being of the same outer diameter but having passaging therein of different cross-sectional area. The nozzle member is adapted to be fitted in the inner portion of the nozzle bore in sealing relationship therewith for forming a first seal for the nozzle assembly. The nozzle assembly further comprises a locknut, separate from the nozzle member, for detachably securing the nozzle member in the nozzle bore, formed at least in part of an abrasion and erosion resistant material. The locknut has a threaded side wall engageable with the outer portion of the nozzle bore, and an aperture therethrough for enabling a stream of drilling fluid from the nozzle member to flow therethrough and being so configured in section as to receive a tool for turning the locknut to install it in and remove it from the nozzle bore.

10 Claims, 4 Drawing Figures

NOZZLE ASSEMBLY FOR AN EARTH BORING DRILL BIT

BACKGROUND OF THE INVENTION

This invention relates to rotary drill bits for drilling well bores in the earth for oil and gas production of the type used in conjunction with the drilling fluid circulation system of a rotary drill rig, and more particularly to nozzle assemblies for such drill bits for directing drilling fluid under pressure against the well bore bottom.

This invention involves an improvement over conventional nozzle assemblies of the type, such as shown for example in U.S. Pat. No. 4,381,825, which are secured in nozzle bores in the bottom of the body of a drill bit and are positioned closely adjacent to the well bore bottom when the drill bit is in the well bore in engagement with the well bore bottom. The bit body has an upper threaded pin adapted to be detachably secured to a drill string used to rotate the bit and a chamber therein in fluid communication with the passage in the drill string. The nozzle bores of the bit body are in fluid communication with the chamber and open to the exterior of the bit body. The drill bit, which is of the so-called "STRATAPAX" drag bit type, is used in conjunction with the drilling fluid circulation system of a rotary drill rig. In this system, drilling fluid under pressure is pumped down the drill string into the chamber in the bit body, with the drilling fluid exiting the bit via the nozzle bores and the nozzle assemblies. Upon exiting the bit, the drilling fluid returns back up to the drill rig via the annular space or annulus between the drill string and the wall of the well bore.

Each nozzle assembly comprises a nozzle member consisting of a cylindrical nozzle portion having passaging therein and a threaded sleeve brazed on the nozzle portion, and a retaining ring for securing the nozzle member in the nozzle bore. The cylindrical nozzle portion sealingly engages a seal member in the nozzle bore and the threaded sleeve is threaded in a threaded portion of the nozzle bore. The retaining ring is press-fit into the nozzle bore and engages the outer face of the nozzle member for preventing unintended rotation of the nozzle member which would cause the nozzle member to move out of the nozzle bore.

While the above-described nozzle assembly has proven to be generally satisfactory, it has a significant limitation; namely, it does not permit the nozzle orifice diameter to be changed. In drilling, the nozzle orifice diameter is preferably chosen so as to maximize the hydraulic cleaning action of the drilling fluid. More particularly, the drilling fluid flows from the nozzle assembly and impinges the well bore bottom at a relatively high velocity, and thus assists the drill bit in drilling the well bore bottom by lifting cuttings from the well bore bottom and flushing them up the annulus between the drill string and the wall of the well bore.

There are two widely accepted theories for maximizing the hydraulic cleaning action of the drilling fluid; namely, (1) deliver the maximum hydraulic horsepower power to the well bore bottom via the stream of drilling fluid exiting the nozzle assemblies, and (2) deliver the maximum hydraulic jet impact force to the well bore bottom. Under the first theory, the drilling fluid flows through the nozzle assembly at such a drilling fluid volume flow rate and fluid velocity that the stream impinges the well bore bottom with the highest energy level as measured in hydraulic horsepower. Under the second theory, the drilling fluid volume flow rate and fluid velocity are such that the stream impinges the well bore bottom with the highest possible impact force. Normally, the hydraulic pumps of the fluid circulation system of a drill rig are operated to deliver the maximum horsepower. Thus, the only variable affecting the drilling fluid flow rate and velocity (and thus its hydraulic energy or impact force), over which the rig operator has control is the nozzle orifice size of the nozzle assemblies. However, because of changes in factors such as drilling depth, the density of the drilling fluid, and the diameter of the drill string, the optimum nozzle orifice size may and often does vary as between the drill bits used in drilling a well bore. Indeed, the optimum nozzle orifice size for an individual bit may change during its use. Thus, to ensure that a drill bit has nozzle assemblies having the optimum nozzle orifice diameter installed therein, the nozzle assemblies must be capable of being installed in the drill bit just prior to its use and to be removed during non-drilling periods of its use, such as when the drill bit is pulled to enable well casing to be installed.

However, with the nozzle assemblies of U.S. Pat. No. 4,381,825, it is not possible to change the nozzle member and thus the nozzle orifice diameter once the retaining ring is pressed into the nozzle bore. Thus, it is not possible to change the orifice diameter during non-drilling periods in the use of this drill bit, nor if the bit is to be reused in drilling a second well bore requiring a different orifice diameter. Moreover, to enable nozzle assemblies having the optimum orifice diameter to be installed in the drill bit just prior to its use, a large inventory of nozzle members must be available at the drill rig. More particularly, there must be a plurality of sets of nozzle members, with each set including one nozzle member for each of the nozzle bores in the drill bit and with the nozzle members of each set having a nozzle orifice diameter different from those of the members of the other sets to provide members having all nozzle orifice diameters anticipated to be needed at the drill rig. Because this nozzle assembly is of unique construction, it cannot be used on drill bits of other types, such as roller cutter drill bits, which would enable the amount of inventory of the nozzle assemblies to be reduced.

SUMMARY OF THE INVENTION

Among the several objects of the invention may be noted the provision of a nozzle assembly for a rotary drill bit which may be readily installed in and removed from the drill bit; the provision of such a nozzle assembly comprising a nozzle member which is a standard nozzle member for roller cutter type drill bits and thus normally available at a drill rig for reducing the inventory of nozzle assembly members needed; the provision of such a nozzle assembly comprising erosion resistant materials at those surfaces thereof exposed to the drill fluid; the provision of such a nozzle assembly which may be installed by use of a single tool and held in place without the need for an accessory retaining device; and the provision of such a nozzle assembly which is economical to manufacture and simple to use.

The nozzle assembly of this invention is used in an earth boring drill bit of the type comprising a bit body having a threaded pin at its upper end adapted to be detachably secured to a drill string, and passaging therein extending from an opening in the pin for receiving drilling fluid under pressure from the drill string down to a nozzle bore in the lower end of the bit and positioned closely adjacent to the well bore bottom when the bit is in engagement therewith for exit of the drilling fluid from the bit. The nozzle bore comprises inner and outer portions of generally circular section in coaxial alignment with each other, the outer portion extending up into the bit from the underside thereof and being defined in part by a threaded side wall, the inner portion of the nozzle bore being defined in part by an inner end wall and carrying a seal member. The nozzle assembly comprises a generally cylindrical nozzle member of an abrasion and erosion resistant material, selected from a plurality of such members, each being of the same outer diameter but having passaging therein of different sectional areas. The passaging extends generally along the central longitudinal axis of the respective nozzle member and tapers from a relatively large opening in one end thereof, constituting its inner end with respect to the nozzle bore, to a relatively small opening at its other end, constituting its outer end. The nozzle member is adapted to be fitted in the inner portion of the nozzle bore in sealing relationship with the seal member, thereby forming a first seal for the nozzle assembly. The nozzle assembly further comprises a locknut, separate from the nozzle member, for detachably securing the nozzle member in the nozzle bore formed at least in part of an abrasion and erosion resistant material. The locknut has a first end, constituting its inner end, engageable with the outer end of the nozzle member, a second end, constituting its outer end, generally closing the opening to the nozzle bore for preventing erosion of the bit body by the drilling fluid exiting the nozzle assembly and splashing back toward the assembly after impinging the well bore bottom, an outer side wall threadingly engageable with the threaded side wall of the nozzle bore for forming a second seal for the nozzle assembly, and an aperture therethrough in alignment with the passage in the nozzle member of larger sectional area than the opening in the outer face of the nozzle member for enabling a stream of high-velocity drilling fluid from the nozzle member to flow therethrough while acting to diffuse the stream. The aperture further is so configured in section as to receive a tool for turning the locknut in one direction to thread it into the nozzle bore and in the outer direction to remove it.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
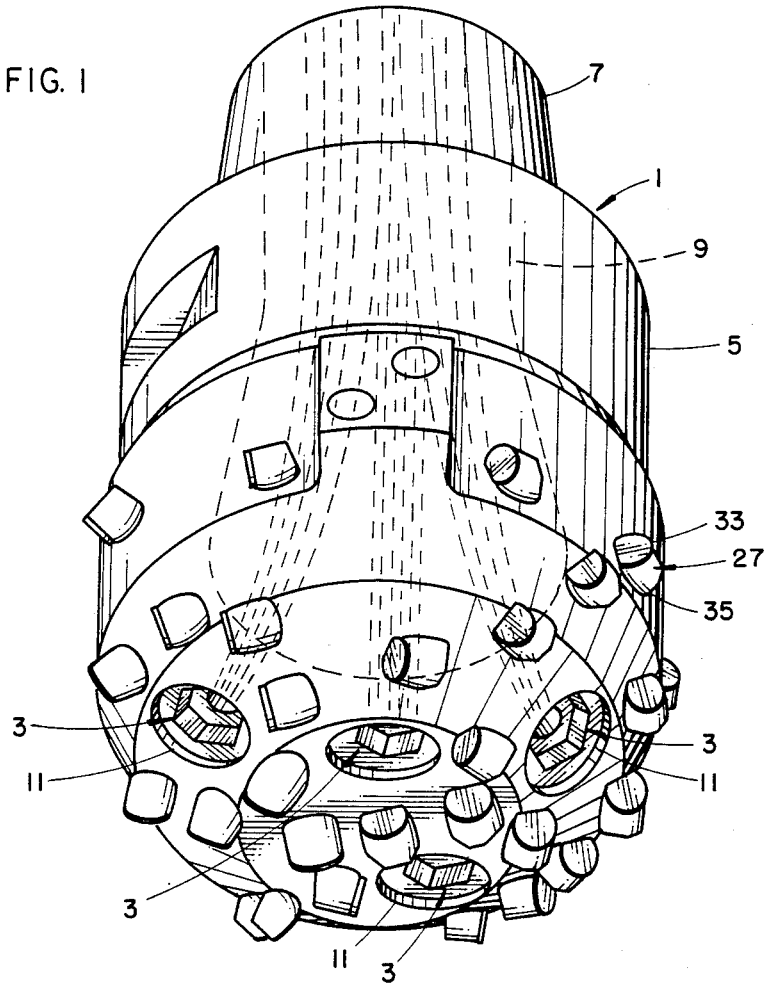
FIG. 1 is a perspective of a rotary drill bit having nozzle assemblies of this invention installed therein.

Referring to FIG. 1, there is generally indicated at 1 a rotary drill bit for drilling a well bore in formations in the earth for oil and gas production, having nozzle assemblies 3 of this invention installed therein. The drill bit is used in conjunction with the drilling fluid circulation system of a drill rig (not shown). In this system, drilling fluid under pressure is pumped down to the drill bit, with the drilling fluid exiting the drill bit via the nozzle assemblies 3 to provide hydraulic cleaning of the well bore bottom and returning back up to the drill rig via the annular space or annulus between the drill string and the side wall of the well bore.

Figure 4:
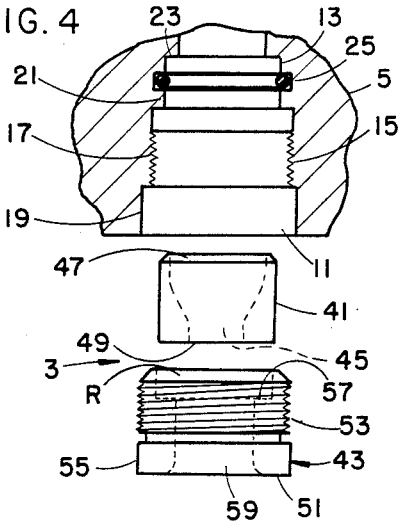
FIG. 4 is an exploded sectional view of FIG. 3 showing the relationship of the components of the nozzle assembly to each other and to the nozzle bore.
Figure 3:
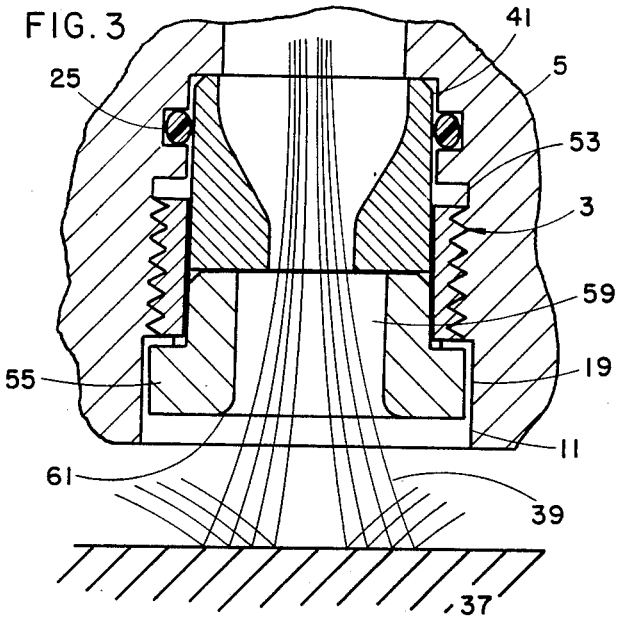
FIG. 3 is an enlarged vertical section on line 3—3 of FIG. 2 showing one of the nozzle assemblies as installed in a nozzle bore in the bit body.

The drill bit 1 comprises a generally cylindrical bit body 5 having a threaded pin 7 at its upper end adapted to be threadingly secured to a drill string (not shown) suspended from the drill rig for rotating the drill bit. The bit body further has passaging therein (represented systematically at 9 in FIG. 1) adapted to receive drilling fluid under pressure from the drill string. The passaging extends from an opening in the pin 7 down to nozzle bores 11 in the lower end of the bit body. As shown in FIGS. 3 and 4, each nozzle bore has a small diameter inner portion 13 and an enlarged diameter outer portion 15 of generally circular section in coaxial alignment with each other. The outer portion 15 extends up into the lower surface of the bit body and is defined in part by a threaded side wall 17 and a counterbore 19. The inner portion 13 of the nozzle bore is defined in part by a side wall 21 and an inner end wall or abutment 23. Side wall 21 has an annular groove therein receiving an O-ring 25 constituting a seal member. The nozzle assemblies 3 are detachably secured in the nozzle bore in sealing relationship, with one nozzle assembly in each nozzle bore 11.

The bit body preferably also has a plurality of cutting elements 27 of the type described in U.S. Pat. No. 4,381,825 secured in blind end holes or bores 31 in the lower or cutting face of the bit body. Each of these cutting elements comprises a layer of synthetic diamond material deposited on a disc of tungsten carbide material to form a so-called compact 33, and an elongate stud 35 of tungsten carbide to which the compact is brazed. Cutting elements of this type are commercially available under the trade designation STRATAPAX from the General Electric Company of Worthington, Ohio. As secured in the holes in the bit body, the cutting elements project beyond the lower surface of the bit body approximately 0.4 inch.

With the drill bit in a well bore and the cutting elements in engagement with the well bore bottom, designated 37 in FIG. 3, the nozzle bores 11 and the nozzle assemblies 3 therein are positioned closely adjacent to the well bore bottom. Being so positioned, the nozzle assemblies (as well as the portions of the lower surface of the bit body adjacent the nozzle bores) are subject to splash back of the drilling fluid. Splash back occurs when the stream of drilling fluid, designated 39 in FIG. 3, exiting a nozzle assembly at a relatively high velocity (e.g., several hundred feet per minute) impinges the well bore bottom and splashes or flows back toward the nozzle assembly. To prevent erosion of the bit body due to splash back the bit body 5 is either formed in part of an erosion resistant material such as tungsten carbide or coated with such a material. As described more fully hereinafter, the nozzle assembly is also formed at least in part of a suitable erosion resistant material.

Referring to FIGS. 3 and 4, each nozzle assembly 3 is shown to comprise a nozzle member 41 and a locknut 43 separate from the nozzle member. The nozzle member 41 is received in the inner portion 13 of the respective nozzle bore in sealing relationship with the seal member 25 for forming a first seal for the nozzle assembly. The locknut has a threaded side wall threadingly engageable with the threaded wall 17 of the outer portion 15 of the nozzle bore for detachably securing the nozzle member in the nozzle bore 11 and forming a second seal for the nozzle assembly.

More particularly, the nozzle member is of generally cylindrical shape and is formed of a suitable abrasion and erosion resistant material such as a powder metallurgy composite maerial; e.g., a graded tungsten carbide with a cobalt binder. It has passaging 45 extending generally along the central longitudinal axis of the respective nozzle member and departing from a relatively large diameter opening 47 in one end thereof, constituting its inner end as fitted in the nozzle bore, to a relatively small diameter opening 49 in its other end, constituting its outer end. The cylindrical side wall of the nozzle member is received in sealing engagement with the O-ring 25 when the nozzle member is fitted in the inner portion 13 of the nozzle bore.

The nozzle member 41 is selected from a plurality of such members, each being of the same outer dimension but having passaging 45 therein of a different sectional area and a different orifice diameter at the outer end thereof within a predetermined range of diameters. Thus, the nozzle member having an orifice diameter such as to provide the drilling fluid volume flow rate and velocity for maximum hydraulic cleaning action for a particular drill bit and its particular use in drilling may be selected and installed in the bit. Moreover, these nozzle members 41 are the same as the standard nozzle members now used for many existing roller cutter type drill bits. By using a standard item of manufacture, the cost of manufacture of the nozzle member 41 is reduced and its availability is significantly increased. In many cases, supplies of the nozzle members in the quantity and nozzle orifice sizes required are already available at drill rigs.

The locknut 43 preferably comprises a generally cylindrical body member 51 of suitable abrasion and erosion resistant material, such as a powder metallurgy composite metal; e.g., a graded tungsten carbide with a cobalt binder, and a threaded sleeve 53 of machinable metal such as steel secured to the body member as by brazing. However, it is also contemplated that the locknut 43 may be of one-piece construction formed entirely of the erosion resistant material.

The body member 51 at its inner end is of the same diameter as the nozzle member 41 and at its outer end has a disc-shaped head 55. The sleeve 53, as secured to the body member, extends beyond the inner end of the body member to form a recess R adapted to receive the outer end of the nozzle member. A suitable sealant material 57 such as that commercially available under the trade designation "LOCTITE 222" from the Loctite Corporation of Mississauga, Ontario, Canada, is applied to the recess R prior to positioning the nozzle member 41 in the recess R. The sealant forms a sealing relationship between the nozzle member 41 and the locknut 43, while enabling them to be separated. The disc shaped head 55 of the locknut substantially covers the nozzle bore 11 at the counter bore 19 for preventing erosion of the bit body by splash back. Moreover, as shown in FIG. 3, the depth of the nozzle bore 11 and the length of the nozzle assembly 3 are so related that the locknut 43 is wholly recessed in the nozzle bore to hold the nozzle assembly out of engagement with the well bore bottom 37 and thus protect it against damage.

Figure 2:
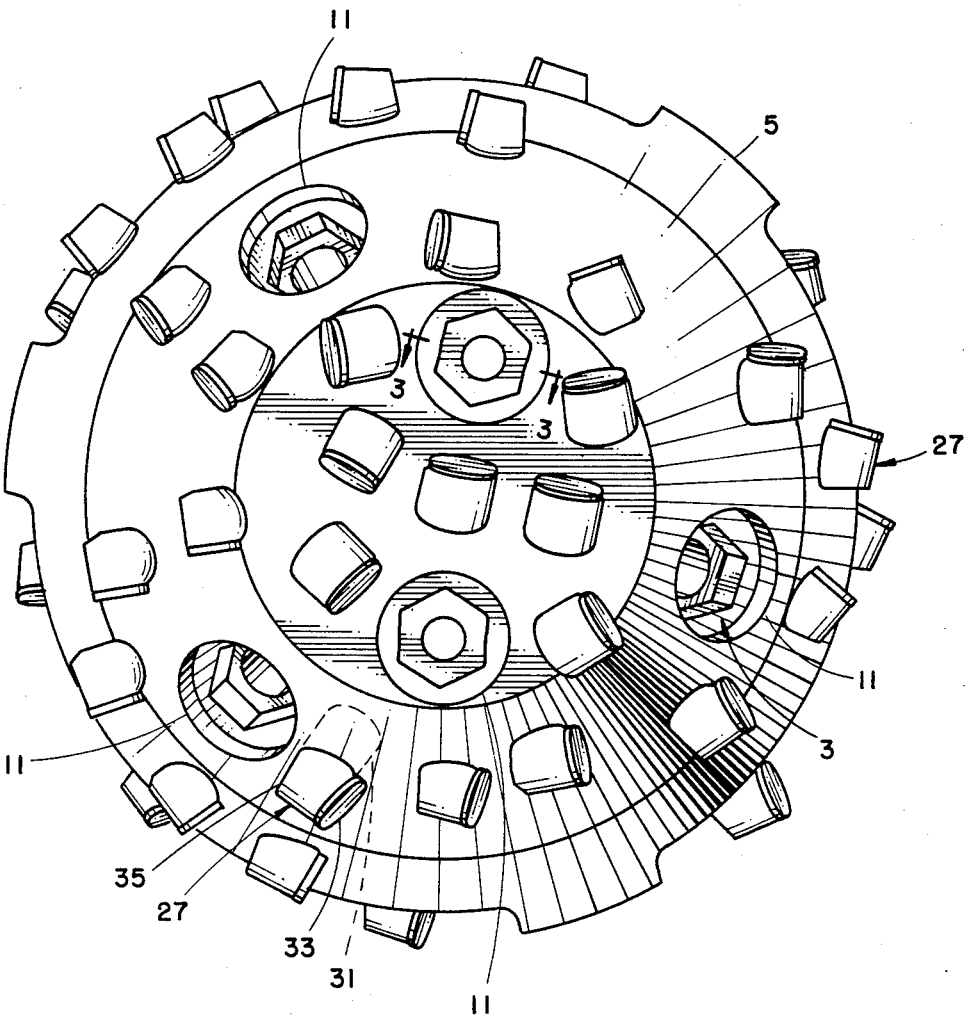
FIG. 2 is an enlarged bottom plan view of the drill bit.

The locknut 43 further has an aperture 59 therethrough in alignment with the passage 45 in the nozzle member. The aperture is of larger sectional area than the orifice 49 in the outer face of the nozzle member for enabling the stream 39 of high velocity drilling fluid to flow therethrough, while acting to diffuse the stream to increase the area of the well bore bottom the stream impacts. This improves the hydraulic cleaning action and reduces splash back. In addition, the aperture is so configured in section (e.g., a hexagonal shape as shown in FIG. 2) on a radial plane through the locknut as to receive a tool (not shown) such as an Allen wrench, for turning the locknut in one direction to thread it into the nozzle bore and in the other direction to remove it. This configuration, together with the relatively large size of the aperture, enables the nozzle assembly to be installed with the use of only a single tool and to be tightened sufficiently that retainer rings or other devices are not needed to hold the nozzle assembly in the nozzle orifice. At its outer end, the aperture has rounded corners or edges 61 to facilitate the diffusion of the stream of drilling fluid.

It will be observed from the foregoing that the nozzle assembly of the invention enables nozzle members having the optimum orifice diameter for maximum hydraulic cleaning to be installed in the drill bit immediately prior to its use and even during non-drilling periods during its use. Moreover, the nozzle members are standard parts used in roller cutter type drill bits and thus may be selected from existing inventories of such nozzle members. In addition, only a relatively small number of locknuts need be provided for any drill bit; namely, one locknut for each nozzle bore. Accordingly, the cost of the nozzle assemblies of this invention to be provided for each drill bit for enabling maximum hydraulic cleaning action of the bit is lower than that for the conventional nozzle assembly.

While the nozzle assembly of this invention is shown and described as being used in a drag bit of the STRATAPAX type, it is contemplated that they could also be used in drag bits of other types such as natural diamond bits shown for example in U.S. Pat. No. 3,112,803 and in roller cutter drill bits of the extended nozzle type shown for example in U.S. Pat. No. 3,363,706 having nozzle orifices positioned closely adjacent the well bore bottom.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A nozzle assembly for an earth boring drill bit of the type comprising a bit body having a threaded pin at its upper end adapted to be detachably secured to a drill string, and passaging therein for receiving drilling fluid under pressure from the drill string extending from an opening in the pin down to a nozzle bore in the lower end of the bit positioned closely adjacent to the well bore bottom when the bit is in engagement therewith for exit of the drilling fluid from the bit, the nozzle bore comprising inner and outer portions of generally circular section in coaxial alignment with each other, the outer portion extending up into the bit body from the underside thereof and being defined in part by a threaded side wall, the inner portion of the nozzle bore being defined in part by an inner end wall and carrying a seal member; said nozzle assembly comprising:

a generally cylindrical nozzle member of an abrasion and erosion resistant material selected from a plurality of such members each being of the same outer diameter but having passaging therein of different sectional areas, the passaging extending generally along the central longitudinal axis of the respective nozzle member and tapering from a relatively large opening in one end thereof, constituting its inner end with respect to the nozzle bore, to a relatively small opening in its other end, constituting its outer end, the nozzle member being adapted to be fitted in the inner portion of the nozzle bore in sealing relationship with the seal member, thereby forming a first seal for the nozzle assembly; and a locknut separate from the nozzle member, for detachably securing the nozzle member in the nozzle bore formed at least in part of an abrasion and erosion resistant metal and having a body portion and a sleeve portion, said body portion including a first end, constituting its inner end, engageably with the outer end of the nozzle member, and a second end, constituting its outer end, generally closing the opening to the nozzle bore for preventing erosion of the bit body and the nozzle assembly by drilling fluid exiting the nozzle assembly and splashing back toward the assembly after impinging the well bore bottom; said sleeve portion extending inwardly beyond the inner end of said body portion to form a recess to receive the outer end of the nozzle member and including an outer side wall threadingly engageable with the threaded side wall of the nozzle bore for forming a second seal for the nozzle assembly, and an aperture therethrough in alignment with the passage in the nozzle member of larger sectional area than the opening in the outer face of the nozzle member for enabling a stream of high-velocity drilling fluid from the nozzle member to flow therethrough while acting to diffuse the stream, with the aperture for at least a substantial portion of its length being so configured in section as to receive a wrench for turning the locknut in one direction to thread it into the nozzle bore and in the other direction to remove it.

2. A nozzle assembly as set forth in claim 1 further comprising sealant material in said recess for forming a sealing relationship between the nozzle member and the locknut.

3. A nozzle assembly as set forth in claim 1 wherein the abrasion and erosion resistant material of the nozzle member and the locknut is tungsten carbide.

4. A nozzle assembly as set forth in claim 1 wherein said outer portion of the nozzle bore has a counterbore at its outer end, and the locknut has a head at its outer end adapted to be received in the counterbore.

5. A nozzle assembly as set forth in claim 1 wherein the depth of the nozzle bore and the length of the nozzle assembly are so related that the locknut is wholly recessed in the nozzle bore when the nozzle assembly is installed in the nozzle bore.

6. A nozzle assembly as set forth in claim 1 wherein the aperture in the locknut at its outer end has rounded courners to facilitate diffusion of the stream of drilling fluid.

7. In an earth boring drill bit having a nozzle bore for receiving pressurized drilling fluid and defining a small diameter side wall and an inner end abutment at an inner end thereof, and an enlarged diameter side wall at the outer end thereof having at least a portion thereof threaded; an improved nozzle assembly fitting within said nozzle bore and comprising:

a generally cylindrical nozzle member having a generally uniform outer diameter throughout its length and passaging along its longitudinal axis tapering from a relatively large opening at its inner end to a relatively small opening at its outer end, and fitting within the small diameter side wall with its inner end in abutting relation with said end abutment;

a locknut having a body portion engaging in abutting relation to the outer end of said nozzle member and having a central aperture therethrough, and a sleeve portion projecting inwardly beyond said body portion having an inner diameter slightly larger than the outer diameter of said nozzle member and substantially the same as said small diameter side wall to form a recess therein to receive the outer end portion of said nozzle member along a substantial portion of the length of said nozzle member and to form generally a continuation of said small diameter side wall of the nozzle bore, said sleeve portion being threaded externally and engaging in threaded relation the threaded side wall portion of the nozzle bore;

the central aperture in said locknut being of a larger cross sectional area than the opening in the outer end of said nozzle member, the aperture for at least a substantial portion of its length being so configured in section as to receive a wrench for turning the locknut in one direction so thread it into the nozzle bore and in the other direction to remove it, said locknut upon being threaded into the nozzle bore engaging the outer end of said nozzle member to press the inner end of said nozzle member into tight abutting relation with the inner end abutment of said nozzle bore.

8. In an earth boring drill bit as set forth in claim 7 wherein a sealant material is positioned in said recess prior to threading of the locknut in said nozzle bore, and seals between said nozzle member and said locknut final assembly thereof.

9. In an earth boring drill bit as set forth in claim 8 wherein said sleeve portion of said locknut is a separate member fitting about said body portion and is secured to the outer periphery of said body portion by brazing.

10. In an earth boring drill bit as set forth in claim 7 wherein the small diameter side wall of said nozzle bore has an annular groove therein, and an O-ring is received within said groove to seal between said nozzle member and said small diameter to side wall.

* * * * *